United States Patent [19]

Muttera

[11] 3,933,560

[45] Jan. 20, 1976

[54] TAG WICKET

[75] Inventor: William H. Muttera, Walnut Creek, Calif.

[73] Assignee: Dennison-Eastman Corporation, Richmond, Calif.

[22] Filed: July 23, 1973

[21] Appl. No.: 381,491

[52] U.S. Cl. ..... 156/227; 156/256; 40/20; 29/417

[51] Int. Cl.[2] ..... B31F 23/10

[58] Field of Search ..... 40/2, 21, 20, 11 A, 26, 40/24, 20; 24/261 C; 156/227

[56] References Cited

UNITED STATES PATENTS

| | | | |
|---|---|---|---|
| 298,629 | 5/1884 | Sencenbaugh | 40/24 |
| 594,484 | 11/1897 | Muller | 40/21 R |
| 1,089,956 | 3/1914 | Polyanich | 40/21 R |
| 1,804,940 | 5/1931 | Kondolf | 40/24 |
| 3,530,545 | 9/1970 | Lengyel | 24/261 C X |
| 3,722,118 | 3/1973 | Burgi | 40/21 R |

*Primary Examiner*—Robert Peshock
*Assistant Examiner*—Wenceslao J. Contreras

[57] ABSTRACT

A wicket for tags comprising a pair of spaced, generally parallel end sections and an intermediate connector strip, the ends of said intermediate strip being integrally joined to one end of each end section and forming a generally Z shape configuration, said wicket being particularly adapted for use as a tag hanger.

4 Claims, 7 Drawing Figures

TAG WICKET

The present invention relates generally to tag hangers or wickets such as those employed by ski resorts for affixing ski tickets to the pants or jackets of skiers. Various forms of wire wickets are commonly used for this purpose. However, the use of metal wires presents the danger of injury in case of a fall, especially with those wire wickets having ends that project laterally outward and are easily exposed.

In brief, the present invention involves a novel form of wicket that may be manufactured of plastic and dispensed in a continuous web without creating material waste. The invention described herein further contemplates a novel arrangement for dispensing the wickets and applying them to tags.

Various other objects of this invention will become apparent in view of the following detailed description.

In the drawings forming a part of this application and in which like parts are identified by like reference numbers:

Figure 1:
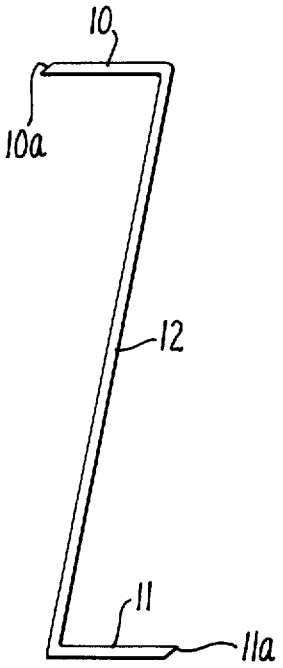
FIG. 1 is a plan view of the novel wicket forming the subject matter of this invention.

Referring to FIG. 1 in particular, there is illustrated a wicket comprising a pair of spaced generally parallel end sections 10 and 11 and an intermediate connector strip 12. The ends of strip 12 are integrally joined to one end of each end section, forming a wicket which has a generally Z shape configuration. One advantage of such a wicket is that it may be die cut from a web of plastic material such as Mylar. However, various kinds and types of material may be used, including metal and paper.

Figure 4:
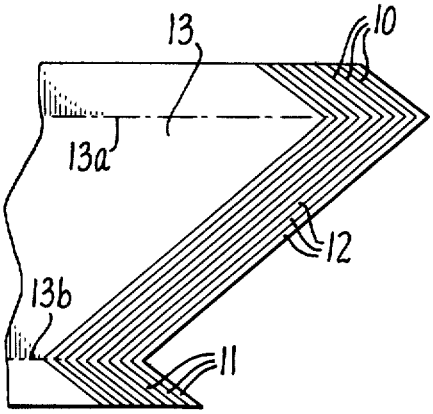
FIG. 4 is a plan view of a nested arrangement of plastic wickets formed from a sheet or web of plastic material.

Referring to FIG. 4, a web 13 is intermittently advanced through a die having the same Z shape as the wickets to be formed. A Mylar web may be selected with a thickness of 0.010 to 0.014 inch, and the web advanced 3/32nd-inch between cutting actions of the die. Other thicknesses and widths of wickets may be selected on the basis of material used and the need for strength. It will be especially noted that the end of the wickets are inclined to the edges of the web 13 and, therefore, the ends become pointed when cut by the die, as indicated by the reference numbers 10a and 11a. The pointed ends allow them to be inserted easily through button holes or the finger grasp of a zipper.

Figure 2:
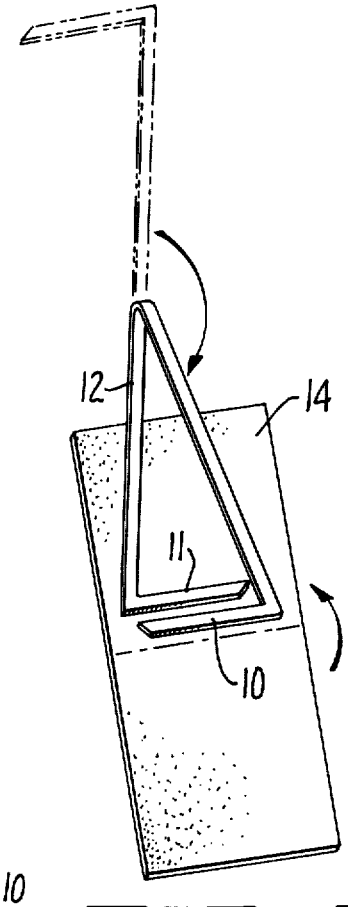
FIG. 2 is a perspective view showing the manner in which the wicket is applied to a ski tag.
Figure 3:
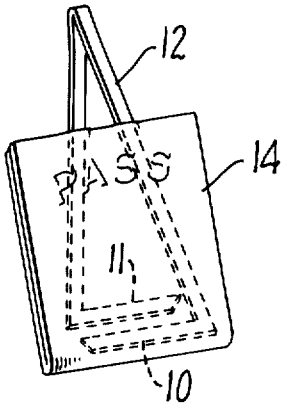
FIG. 3 is a perspective view of the ski tag fully assembled to the wicket.

The wickets are applied to a ski tag 14 in the manner shown in FIG. 2. The wicket is first folded at approximately the middle of the intermediate connector strip; one end section is then inserted through the belt loop, button hole or finger tab of a zipper; and the two end sections are then sandwiched between the adhesive coated surfaces of ticket 14 in a manner that is customary in the application of ski tickets to wire wickets. When applying the ski ticket to the wicket, end sections 10 and 11 are preferably positioned side by side, as shown in FIGS. 2 and 3, rather than in overlapping fashion. This produces a better attachment to the wicket.

Figure 5:
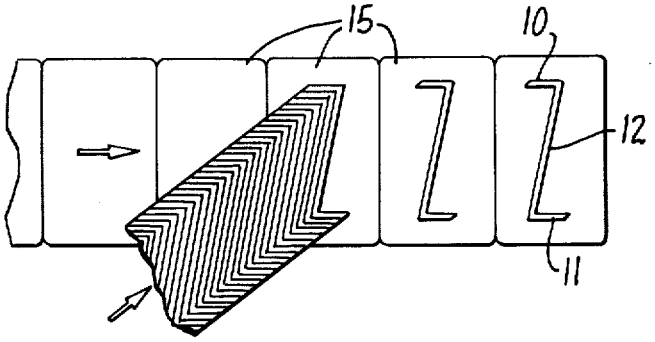
FIG. 5 is a perspective view illustrating the manner in which the wickets may be production assembled to a series of tickets or tags.
Figure 6:
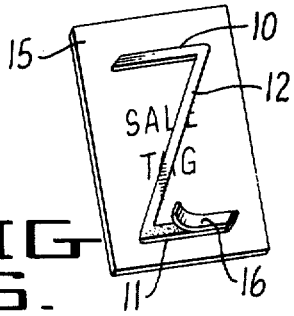
FIG. 6 is a perspective view of a "sale" tag having a wicket mounted thereto.
Figure 7:
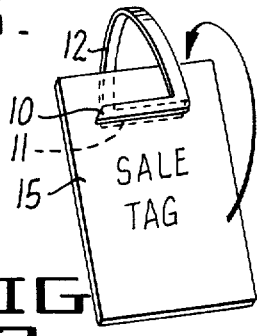
FIG. 7 is a perspective view of the "sale" tag illustrating the manner in which a wicket may be used to form a loop or hanger for the tag.

FIGS. 5–7 illustrate a novel arrangement of the wicket in combination with a "sale tag" 15. In this instance, the wickets are applied to tags 15 in an automated process. One end section of each wicket is secured to a tag adjacent the top portion thereof. The other end section and intermediate connector strip extend generally downward from the affixed end section and, therefore, overlie a lower portion of the tag. The one end section may be secured to the tag as by means of adhesive. An adhesive material, preferably a pressure sensitive type of adhesive, is also applied to a surface of the other end section but on the side away from the tag, as shown in FIG. 6. The adhesive coating provided on the other end section is protected by a small liner strip 16.

In use, liner 16 is removed and the end section to which the liner had been attached is rotated around the top of the tag and secured to the opposite side as shown in FIG. 7.

It is contemplated that adhesive materials may be applied to the end sections of the wickets during an early stage of manufacture. More particularly, and referring to FIG. 4, the adhesive material may be applied initially to the areas of web 13 from which the end sections are formed. Thus, applying an adhesive material in the region between the imaginary line 13a and the near side of the web would provide a coating of adhesive to each of the end sections 10. Similarly, an adhesive material applied in the area between the imaginary line 13b and its near side of the web would provide a second adhesive coating to end sections 11.

Although wickets of this invention have a generally Z shape configuration, the size and angularity of end sections relative to the intermediate connector strip may be varied through a wide range. Also, the included angles between the end sections and intermediate connector strip may vary and one included angle may be greater or smaller than the other. Thus, it is to be understood that various modifications and changes may be resorted to without departing from the spirit of the invention or the scope of the attached claims, and each of such modifications and changes is contemplated.

What is claimed is:

1. A method for forming a tag fastener without substantial waste and securing a tag thereto, comprising the steps: cutting a web of sheet-like material into a multiplicity of continuous thin nestable strips of material, each said strip comprising a pair of spaced, generally parallel end sections and an intermediate connector strip, the ends of said intermediate connector strip being integrally joined to one end of each end section to form a generally Z shaped configuration; folding each said strip at a point along the intermediate connector strip between the parallel end sections, thereby forming a generally triangular configuration having a base and an apex; and bonding a tag to the base of said triangular configuration.

2. The method of claim 1, one end section being inserted through the loop of an article of clothing prior to the folding thereof.

3. The method of claim 1 wherein the bonding step comprises adhesively attaching the tag to the fastener.

4. The method of claim 1 wherein the cutting step comprises:

advancing the sheet of material along an axis of movement; and moving a die cutter having a pair of spaced generally parallel end section cutters and an intermediate connector cutter disposed in a generally "Z" configuration into cutting engagement with the sheet of material, the pair of end section cutters being disposed at an acute angle relative to the axis of material movement and intersecting the lateral edges of the sheet material to form pointed ends on the strip end sections.

* * * * *